US006055969A

United States Patent [19]

Oishi et al.

[11] Patent Number: 6,055,969

[45] Date of Patent: May 2, 2000

[54] IGNITER FOR INTERNAL COMBUSTION ENGINE HAVING OUTER PACKING CASE EQUIPPED WITH COIL AND IGNITER UNIT

[75] Inventors: Hidetoshi Oishi, Utsunomiya; Noboru Sugiura, Mito; Kazutoshi Kobayashi, Hitachinaka; Hiroshi Watanabe, Takahagi; Katsuaki Fukatsu, Urizura-machi; Eiichiro Kondo, Mito; Yoichi Anzo; Masaru Ujigawa, both of Hitachinaka; Junichi Shimada, Mito; Kenji Nakabayashi, Hitachinaka, all of Japan

[73] Assignees: Hitachi, Ltd., Tokyo; Hitachi Car Engineering Co., Ltd., Ibaraki, both of Japan

[21] Appl. No.: 09/256,093

[22] Filed: Feb. 24, 1999

Related U.S. Application Data

[63] Continuation of application No. 08/922,576, Sep. 3, 1997, Pat. No. 5,915,367.

[30] Foreign Application Priority Data

Sep. 3, 1996 [JP] Japan ..... 8-233188

[51] Int. Cl.[7] ..... F02P 3/05; F02P 3/055

[52] U.S. Cl. ..... 123/635; 123/644; 123/647; 123/651

[58] Field of Search ..... 123/143 C, 609, 123/634, 635, 644, 647, 651

[56] References Cited

U.S. PATENT DOCUMENTS

| | | | |
|---|---|---|---|
| 5,365,909 | 11/1994 | Sawazaki et al. | 123/647 X |
| 5,632,259 | 5/1997 | Konda et al. | 123/634 |
| 5,664,550 | 9/1997 | Ito et al. | 123/630 |
| 5,723,916 | 3/1998 | Disney et al. | 123/630 X |

FOREIGN PATENT DOCUMENTS 4-62359 5/1992 Japan .

*Primary Examiner*—Tony M. Argenbright
*Attorney, Agent, or Firm*—Evenson, McKeown, Edwards & Lenahan, PLLC

[57] ABSTRACT

In order to reduce the bulk and weight of the upper igniter case division of the armor case, and to lower the center of gravity of the total apparatus so as to provide an igniter which is tough to oscillate, the igniter for the internal combustion engine has the armor case equipped with the coil department and igniter unit therein, and said armor case has the igniter case having the coil department case and the connector department. Furthermore, the coil department case is inserted in the plug hole of the internal combustion engine. The igniter unit is mounted in the igniter case. Furthermore, the igniter unit has a semiconductor device of a simple substance silicon chip having integrated therein a semi-conductor for switching and a current limiting circuitry. The semi-conductor for switching consists of an insulated bipolar transistor (IGBT) or a power transistor.

6 Claims, 5 Drawing Sheets

IGNITER FOR INTERNAL COMBUSTION ENGINE HAVING OUTER PACKING CASE EQUIPPED WITH COIL AND IGNITER UNIT

This application is a continuation of application Ser. No. 08/922,576, filed Sep. 3, 1997, now U.S. Pat. No. 5,915,367.

BACKGROUND OF THE INVENTION

The present invention relates to an igniter for an internal combustion engine, and especially relates to a cylindrical igniter installed in a plug hole provided in a cylinder head compartment of said internal combustion engine.

As a conventional igniter for the internal combustion engine, it is known to provide a unified ignition coil and power switch. The power switch switches on and off a first electric current of an ignition coil. The igniter is installed in a plug hole provided in the cylinder head compartment of the internal combustion engine.

For example, the igniter described in the Utility Model Laid-open 4-62359 (1992) reference has a cylindrical shape. A center core thereof (open magnetic circuit iron core) is arranged in a central part of the cylindrical shape. A primary coil and a secondary coil are wound around the circumference of the center core. The igniter is constructed with an ignition coil body in which a side core (outer packing iron core) around the circumference of the secondary coil and an igniter unit (integrated circuit package body) are arranged in order to accommodate a power switch on the upper part of the ignition coil body, thereby the ignition coil body and the igniter unit are mounted in one under the outer packing case forming a coil accommodating compartment of the cylindrical shape. A connector compartment for electrical connections is disposed on an upper part of the outer packing case.

In the above-mentioned prior art, when the coil body is received in the plug hole, the igniter unit extends out into the upper part of the plug hole and the connector compartment is arranged in the upper part of the igniter unit, thereby an inconvenience arises in that the total height of the ignition device becomes too high.

SUMMARY OF THE INVENTION

In order to help alleviate such an inconvenience, the inventors of the present application have proposed an ignition device 50 for an internal combustion engine as shown in FIGS. 7A–B, which is disclosed in Japanese Laid-open Patent Application No. 9-63873. The ignition device 50 is constructed with an outer packing case 52 equipped with a coil body 51, an igniter unit 60 and a coil compartment case 53 having a cylindrical shape in which is installed the coil body 51. The ignition device further includes an igniter case 54 of a cup-type shape arranged in the upper part of the coil compartment case 53, and an electrical connector 55 arranged together as one on a side of the igniter case 54.

In igniter case 54, the igniter unit 60 is provided. A power transistor chip 62 and a hybrid IC circuit 63 on a metal base 61 made of copper or aluminum molded in the form of a box is installed in the igniter unit 60. Silicon gel is used to fill up the metal base 61. The terminal block 64 molded with thermoplasticity synthetic resin of polybutylene-terephthalate etc. is glued together with silicon bonding-material to the metal base 61. On an igniter side terminal 65 fixed on the terminal block 64, a primary coil terminal 67 and a connector side terminal 66 are welded to form an electrical connection.

Incidentally, in the above-mentioned technical suggestions, the igniter unit 60 has a separately arranged configuration with a semiconductor element which is a power transistor chip 62 provided in a metal base 61 made of aluminum and a hybrid IC circuit 63 which is a control circuit for controlling a current value flowing through the semiconductor element. Therefore, an area allocated for the power transistor chip 62 in the igniter case (the igniter accommodating compartment) 54 located in the upper part of the armor outer packing case 52 and the hybrid IC circuitry 63, becomes larger in comparison with a cross section of the coil compartment case 53. As a result, an inconvenience results in that the igniter case (the igniter accommodation compartment) 54 becomes large and the weight thereof becomes heavy.

This means that the upper portion projecting from a plug hole of the internal combustion engine becomes big in the igniter 50 mentioned above. Thereby, as the center of gravity of the igniter 50 mentioned above is moved upward, there arises a problem in that the igniter 50 becomes vulnerable to oscillations of the internal combustion engine.

The present invention is designed with reference to such problems. The object of the invention is to reduce the bulk and weight of the upper igniter case of the armor case, and to lower the total center of gravity of the apparatus so as to provide an igniter which is not vulnerable to engine oscillations.

In order to achieve the above objects, the igniter for the internal combustion engine in the present invention has an armor case equipped with a coil compartment and an igniter unit. The armor case has the igniter case having the coil compartment case and connector compartment. The case of the coil compartment is disposed to be inserted in a plug hole of the internal combustion engine. Further, such an arrangement is suitable for an igniter-type in which the igniter unit is put in the igniter case, and the present invention has a feature wherein the igniter unit has a semiconductor device of the silicon chip which has built-into it a semiconductor for switching, and current limiting circuitry.

As practical embodiments of the present invention, an insulated bipolar transistor (IGBT) or a power transistor is used as the semiconductor for the switching feature mentioned above. The unit is provided with a diode having an input clamp function (Zener diode) and a connection relay terminal. The semiconductor element of said single body silicon chip and the diode are connected with a connector terminal through the connection relay terminal. The diode is mounted on a top surface of the connection relay terminal. Furthermore, the semiconductor element of the silicon chip, the diodes and the connection relay terminal are fixedly mounted on the metal base plate top.

In the igniter for the internal combustion engine of the present invention constituted in this way, the igniter unit may be constructed to be compact by having the switching semiconductor and the current limiting circuitry which are a main part of the igniter unit, built-in in the single body silicon chip. As a result, the igniter accommodation compartment of the igniter case may be compact and light weight, thereby an igniter having a strong armor case for oscillation of the internal combustion engine may be supplied.

Moreover, by arranging the connection relay terminal in the igniter accommodation compartment, a connection terminal of the semiconductor device of the silicon chip of the single body and a connector edge member for connecting with the outside may be connected through the connection relay terminal, and said terminals are connected easily. Furthermore, by mounting the diode such as a Zener diode on the upper part of the connection relay terminal, the Zener diode may be compactly accommodated in the igniter accommodation compartment, and electric wiring and junction are easily performed too by utilizing the connection relay terminal.

DETAILED DESCRIPTION OF THE PREFERRED EMBODIMENTS

One embodiment of the present invention will be explained as follows using the figures.

Figure 1:
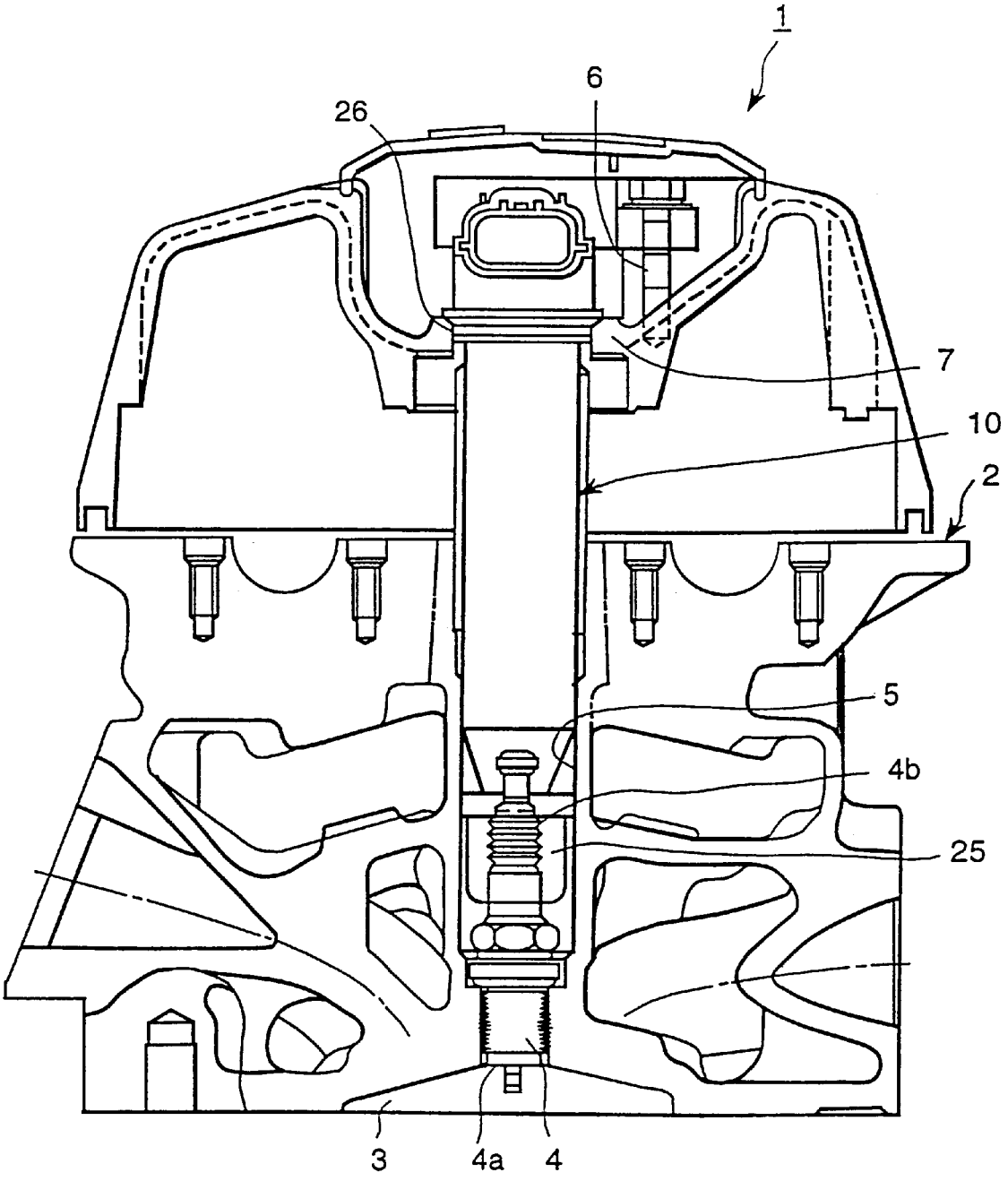
FIG. 1 shows a sectional view of the cylinder head compartment of the internal combustion engine equipped with the igniter as one embodiment of the present invention.

FIG. 1 is a sectional view used to show the state of the internal combustion engine 1 equipped with an igniter 10 on a cylinder head compartment 2 in an embodiment of the present invention.

On the cylinder head compartment 2 of the internal combustion engine 1 mentioned above, a spark plug 4 whose head 4*a* projects into a combustion chamber 3 of the internal combustion engine 1 is mounted thereon, and in an upper plug hole 5 for the spark plug 4, an igniter 10 in accordance with an embodiment of the invention is mounted. Another end 4*b* of the spark plug 4 mentioned above is inserted in a rubber housing 25 under the igniter 10, and it is connected with the igniter 10 electrically. The upper part of the igniter 10 is fixed to a cover department of the cylinder head compartment 2.

Figure 2:
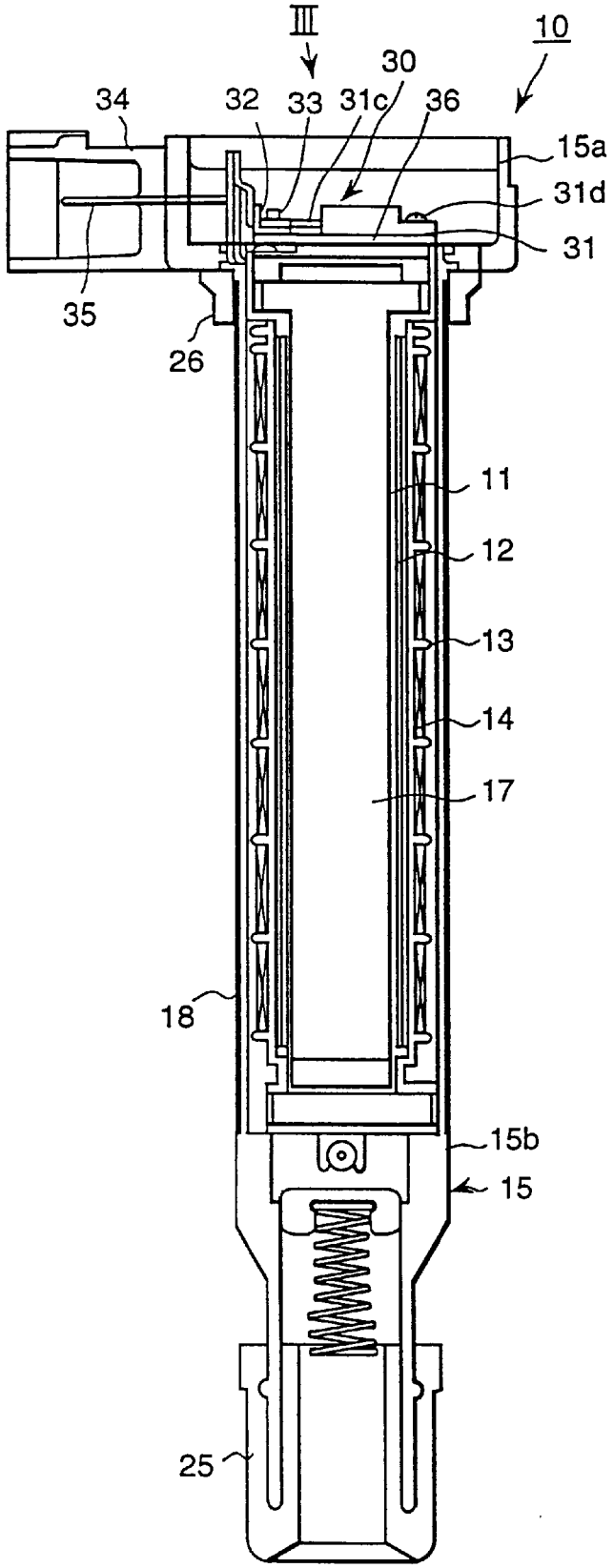
FIG. 2 shows a longitudinal sectional view of the igniter for the internal combustion engine in FIG. 1.
Figure 3:
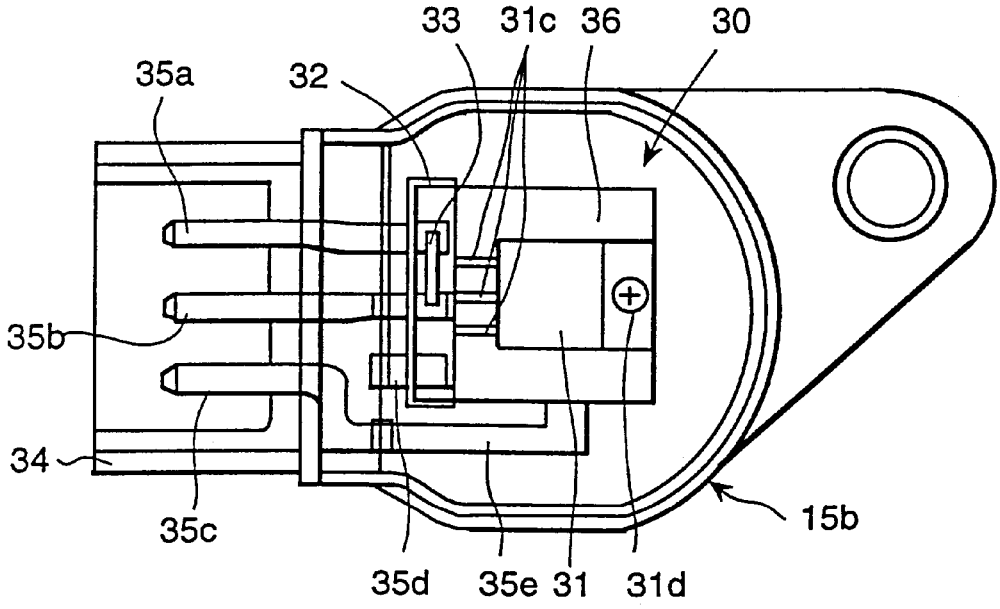
FIG. 3 shows a plan view of the igniter case viewed in the direction of arrow III in the igniter for the internal combustion engine in FIG. 2.

FIG. 2 is a sectional view of the igniter 10 in an embodiment of the present invention, FIG. 3 is the plan view of the igniter 10 shown in FIG. 2 viewed from the direction of arrow III as shown in FIG. 2. A center core (open magnetic circuit iron core) 17 is arranged in a central part of the igniter 10, and said center core 17 is constructed by press laminating silicon steel plates together. The primary bobbin 11 fits in a periphery of the center core 17. Around the periphery of the first bobbin 11, a primary coil 12 consisting of an enamel wire is wound.

The secondary bobbin 13 fits on the outside of the primary bobbin 11, and furthermore, in the secondary bobbin 13, divided secondary coils 14 are wound. Around the periphery of the secondary bobbin 13, an armor case 15 is fitted. Furthermore, on the outside of the coil case compartment 15*b* of the armor case 15, a side core (armor iron core) 18 is formed of a thin silicon steel plate in a tube-like form.

In a part which contacts a cover of the cylinder head compartment 2 of the internal combustion engine 1 of the coil compartment case 15*b* mentioned above, a rubber seal 26 for sealing is arranged. At the same time, in the upper part of the armor case 15, a connector compartment 34 for electrically connecting and an igniter case 15*a* are arranged. In an upper part of the coil of the igniter case 15*a*, an igniter unit 30 is disposed.

Furthermore, the igniter case 15*a* of the armor case 15 mentioned above is formed with polybutylene terephthalate in order to lessen the oscillation effects and to increase the dimensional accuracy of the connector 34, and as shown in FIG. 2, it is shaped like a glass to serve as an accommodating compartment and the connector 34 of the igniter unit 30. In a junction part with the coil department case 15*b*, a part having a step and a projection for positioning are arranged. On the other hand, the coil compartment case 15*b* is formed with a material of polyphenylene sulfide (PPS) which is mixed with conversion polyphenylene oxide (conversion PPO) in about 20%, for example.

Igniter unit 30 mentioned above is constructed with a semiconductor device 31 of a single silicon chip which has an insulated bipolar transistor (IGBT) 31*a* (described later cf. FIG. 5) and a current limiting circuitry 31*b* built-in. The semiconductor device 31 is mounted on a metal base top 36 made of copper, iron or aluminum. A connection relay terminal 32, and a Zener diode 33 functioning as an input voltage clamp are mounted on the connection relay terminal top 32. Silicon gel is filled up on the metal base top 36 mentioned above.

Figure 4A:
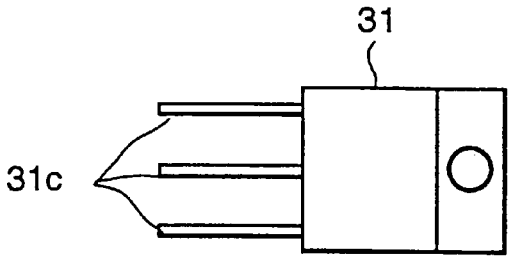
FIGS. 4(A), 4(B) show a semiconductor device having a single silicon chip which is equipped on the igniter for the internal combustion engine in FIG. 2, with FIG. 4(A) showing a plan view of said semiconductor device and FIG. 4(B) showing a side view thereof.
Figure 4B:
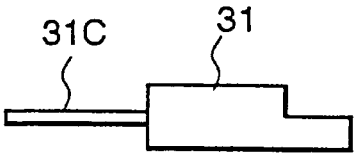

The semiconductor device 31 of the single silicon chip has the appearance shown in FIGS. 4(A) and 4(B). The metal base 36 made of copper is molded and is soldered to the connection relay terminal with a solder (For example, lead:tin=80 to 90 %:10 to 20%, or Sn:Sb:Ni:P=90 to 97%:4 to 8%:0.3 to 0.9%:0.01 to 0.2%)

Semiconductor device 31 being the single silicon chip mentioned above has three lead terminals 31*c* (some times three to six terminals), and said lead terminal 31*c* is joined to the connection relay terminal 32 by means such as press fitting, soldering, welding, adhesion, etc.

Moreover, the semiconductor device 31 being the single silicon chip is fixed to an igniter case 15*a* with the metal base 36 by a screw 31*d* considering increase of power consumption, and atmospheric changes due to the higher temperature, or by a case, it is fixed by the soldering, or adhesive (having electro-conductivity, electrical insulation). The connection relay terminal 32 is fixed to the connector terminals 35*a*, 35*b* of the connector, by welding or crimping, in order to connect with the external equipment. The connection relay terminal 32 is fixed so as to connect to a starting end 35*d* of the primary winding 11 of the coil. The connector terminal 35*c* is fixed on another end 35*e* of the primary winding 11. The Zener diode 33 is mounted on the upper part of the connection relay terminal 32.

Figure 5:
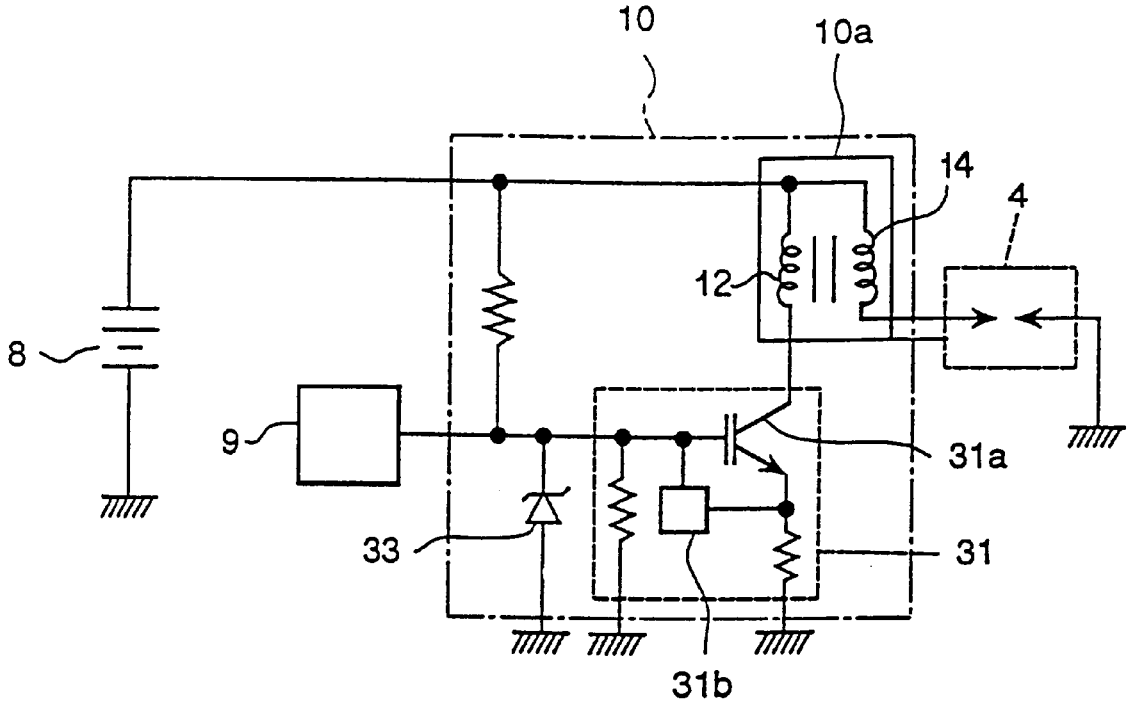
FIG. 5 shows an ignition control circuit of the igniter for the internal combustion engine in FIG. 2.

FIG. 5 shows an ignition control circuit of the igniter 10 in the embodiment of the present invention. The igniter 10 has an ignition coil compartment 10*a* consisting of a primary coil 12 and a secondary coil 14. The igniter circuit 10 further includes the semiconductor device 31 of the single silicon chip, and the Zener diode 33. An insulated bipolar transistor (IGBT) 31*a* and current limiting circuitry 32*b* are built-in the single silicon chip 31. The ignition control signal from the control unit 9 of the internal combustion engine is provided as an input signal to the IGBT 31*a*, and makes a base current flow intermittently from the base to the emitter, thereby, a current flows from the collector into the emitter as an output of said base current, that is to say, a current flows from a battery 8 (that is an electric power supply) into the primary coil 11 of the ignition coil compartment 10*a* so that a magnetic field is generated.

In the ignition of the spark plug 4, the current to the primary coil 11 is cut by an ignition signal from the control unit 9 to the IGBT 31*a*, and the magnetic field generated by the primary coil 11 becomes zero, thereby an electromotive force having a big voltage is generated in the primary side of the coil, and, by generating said electromotive force, a higher voltage is generated on the secondary coil 14 of the ignition coil department 10*a* so as to make the spark plug 4 spark.

The Zener diode 33 mentioned above functions to clamp the input voltage, and by making a difference large, between an input voltage to the IGBT 31*a* in a usual operation and other input voltage to the IGBT 31*a* when a signal line between the control unit 9 and the igniter 10 is disconnected by any possible cause, thereby it becomes possible to clearly set a reference voltage value of a comparator (omitted in the figure) which is a detection function part to detect the cutting of the wire in a side of the control unit 9, and it is an essential element for this ignition control circuit to make the detection of the cutting of the wire easy.

As the igniter for the internal combustion engine in the embodiment of the present invention is constructed with the single silicon chip 31 built in with the switching semiconductor 31*a* of a main part of the igniter unit 30 and the current limiting circuitry 31*b* as stated above, it becomes possible to make an area necessary for the igniter unit 30 very small. As a result, the igniter accommodating compartment of the igniter case 15*a* mentioned above becomes compact and light, and an igniter having an armor case 15 which is strong for vibration of the internal combustion engine is provided.

By arranging the connection relay terminal 32 in the igniter accommodating compartment, a connection between connection terminals 31*c* of the semiconductor device 31 and connector edge members 35*a*, 35*b*, 35*c* for connecting with outside electricity is performed through the connection relay terminal 32, and a connection between said terminals is easily performed. By mounting the Zener diode 33 on the upper part of the connection relay terminal 32, the Zener diode 33 is accommodated in the igniter accommodating part, and the electric wiring and the junction become easy by utilizing the connection relay terminal 32.

The Zener diode 33 mentioned above may be built in the semiconductor device 31, however, because the Zener diode 33 is a power system element and needs a pretty big area for accommodation thereof, and as a result, not only area of the semiconductor device 31 of the silicon chip becomes large, but the manufacture cost becomes high when it is built in one body and there arises a problem in that the standardization of the element is difficult. Therefore, it is desirable to form the Zener diode 33 as a separate body.

One embodiment of the present invention is explained in detail above, however the present invention is not limited to said one embodiment of the present invention, and various modification of the present invention may be easily provided within the field which do not deviate from the present invention as defined in the claims.

Figure 6:
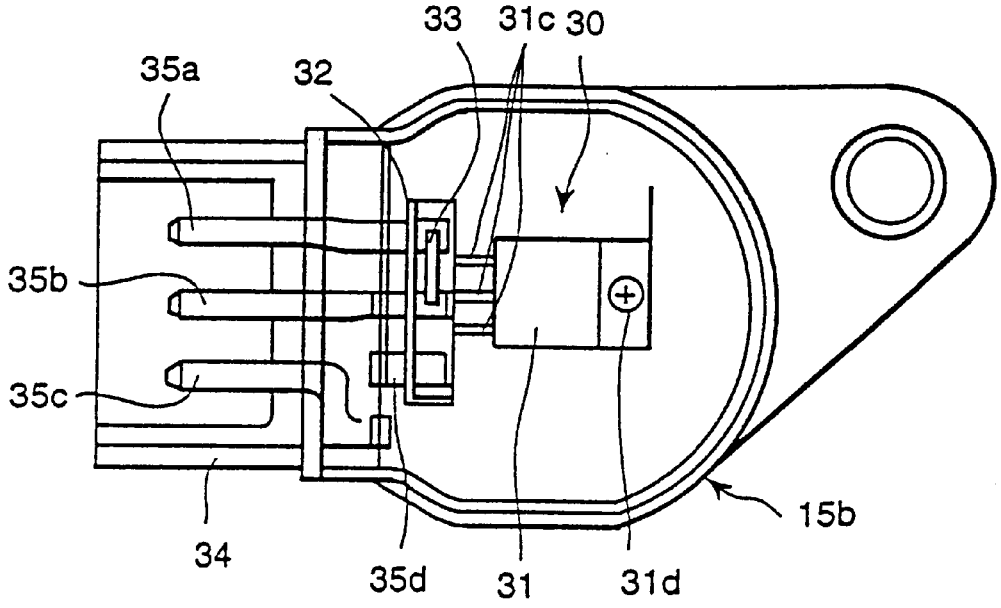
FIG. 6 shows a plan view of the igniter case of the igniter for the internal combustion engine according to an embodiment of the present invention.
Figure 7A:
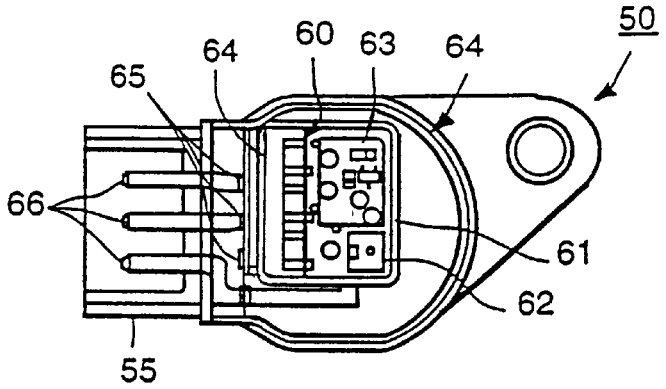
FIG. 7A PRIOR ART
FIGS. 7(A), 7(B) show an igniter for the internal combustion engine, with FIG. 7(A) showing a plan view of the igniter case and FIG. 7(B) showing a longitudinal section of the igniter for the internal combustion engine.
Figure 7B:
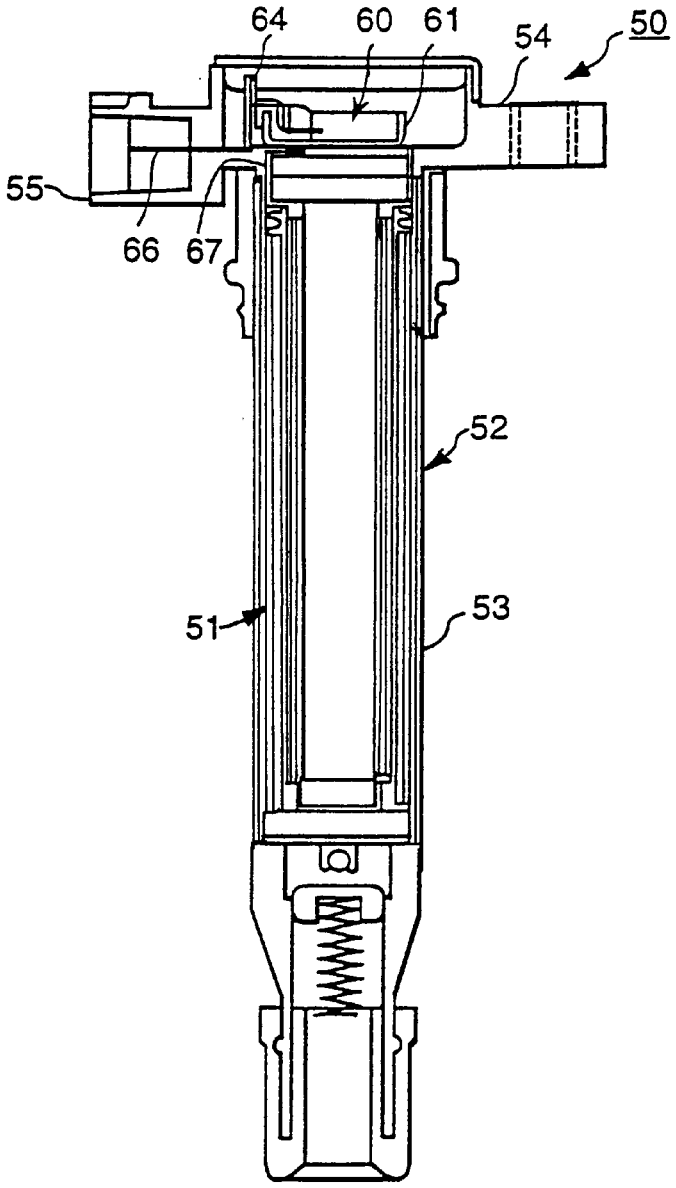
FIG. 7B PRIOR ART

For example, when applying the present invention to the igniter case 15*a* of the semiconductor device 32 of the silicon chip, the semiconductor device 32 of the silicon chip may be directly mounted on the igniter case 15*a* as shown in FIG. 6 without using the metal base. In this case, the igniter case 15*a* is directly mounted to the connection relay terminal 32.

Moreover, the igniter 10 arranging the bobbin 14 of the secondary coil outside of the bobbin 12 of the primary coil is explained in the embodiment mentioned above, and the present invention may be applied to the igniter arranging the bobbin of the primary coil outside of the bobbin of the secondary coil.

Although the insulated bipolar transistor (IGBT) is used as the semi-conductor for the switching built in the semiconductor device of the single silicon chip in the embodiment mentioned above, other power transistors may be used in the same way.

As is apparent from the above-mentioned description, the igniter for the internal combustion engine of the present invention is mounted with the semiconductor device formed of a single substance silicon chip having integrated therein the insulated bipolar transistor (IGBT) and the current limiting circuitry in the igniter accommodation compartment of the igniter case, thereby the igniter accommodation compartment of the igniter case is improved so as to be compact and light and an igniter which is stiffened for the oscillations by the internal combustion engine may be provided.

Moreover, as the connection relay terminal is arranged in the igniter accommodation compartment, the connection terminal of the semiconductor device and the connector side terminal connected to the outside electricity are connected through the connection relay terminal, and the connection between said terminals is easily provided.

As the Zener diode is arranged to be connected with the upper part of the connection relay terminal, the Zener diode furthermore may be compactly accommodated in the igniter accommodation compartment, and as the connection relay terminal is utilized as the mounting place, electric wiring and adhesion are easily performed.

What is claimed is:

1. An igniter apparatus for an internal combustion engine, comprising:

a tubular ignition coil compartment, and an igniter unit mounted on an upper end of said tubular ignition coil compartment, said igniter unit having a resin case, said resin case containing a metal base therein, said metal base fixedly mounting a semiconductor device thereon on a side of said metal base facing away from said tubular ignition coil compartment, said semiconductor device being constructed as a single chip having a power switching element and an electric current limiting circuit for limiting an electric current flow in said power switching element.

2. An igniter apparatus for an internal combustion engine, comprising:

a tubular ignition coil compartment, and an igniter unit mounted on an upper end of said tubular ignition coil compartment, said igniter unit having a resin case, said resin case containing a metal base therein, said metal base fixedly mounting a semiconductor device thereon on a side of said metal base facing away from said tubular ignition coil compartment, said semiconductor device being constructed as a single chip having a power switching element and an electric current limiting circuit for limiting an electric current flow in said power switching element, wherein an upper side of said metal base is filled with an electrical insulation substance.

3. An igniter apparatus for an internal combustion engine, comprising:

a tubular ignition coil compartment, and an igniter unit mounted on an upper end of said tubular ignition coil compartment, said igniter unit having a resin case, said resin case containing a metal base therein, said metal base fixedly mounting a semiconductor device thereon, said semiconductor device having a power switching element and an electric current limiting circuit for limiting an electric current flow in said power switching element; wherein a metal terminal is provided on said resin case, a connection relay terminal is provided on said metal base, and a terminal of said semiconductor device is connected to said metal terminal through said connection relay terminal.

4. An igniter apparatus for an internal combustion engine as defined in claim 3, wherein said terminal of said semiconductor device is thinner than said metal terminal.

5. An igniter apparatus for an internal combustion engine as defined in claim 4, wherein said metal terminal has two terminals extending from said connection relay terminal to outside of the resin case and one terminal connected to said tubular igniting coil.

6. An igniter apparatus for an internal combustion engine as defined in claim 3, wherein said metal terminal has two terminals extending from said connection relay terminal to outside of the resin case and one terminal connected to said tubular igniting coil.

* * * * *